US005461187A

United States Patent [19]

Dudley

[11] Patent Number: 5,461,187

[45] Date of Patent: Oct. 24, 1995

[54] MUSICAL POSTAGE STAMP DISPLAY DEVICE

[76] Inventor: Roger W. Dudley, 6647 Kerns Rd., Falls Church, Va. 22042

[21] Appl. No.: 643,901

[22] Filed: Jan. 18, 1991

[51] Int. Cl.[6] ..... G10F 1/12

[52] U.S. Cl. ..... 84/94.2; 84/95.2

[58] Field of Search ..... 84/94.1, 94.2, 84/95.1, 95.2; 40/158.1, 152.1, 441, 431, 455

[56] References Cited

U.S. PATENT DOCUMENTS

| | | | |
|---|---|---|---|
| 2,279,182 | 4/1942 | Snyder | 84/95.1 X |
| 2,484,895 | 10/1949 | Links | 84/95.2 |
| 2,484,896 | 10/1949 | Links | 84/95.2 |
| 2,570,976 | 10/1951 | Patz | 84/95.2 |
| 3,522,673 | 8/1970 | Dudley . | |
| 3,523,478 | 8/1970 | Van Zanten | 84/95.1 |
| 4,083,137 | 4/1978 | Rozmanith | 40/158.1 |
| 4,102,067 | 7/1978 | Tarrant | 40/152.1 X |
| 4,193,648 | 3/1980 | Gargiulo | 84/94.2 X |
| 4,801,478 | 1/1989 | Greenblatt | 84/94.2 X |
| 4,889,748 | 12/1989 | Dudley | 40/158.1 X |
| 4,947,722 | 8/1990 | Lewis | 84/95.2 |

OTHER PUBLICATIONS

Musical Boxes and Musical Novelties Catalog, Schellhase Co., New York, New York, 1962 p. 1.

Encyclopedia of Automatic Musical Instruments, The Vestal Press, Vestal, New York, 1972, pp. 112, 113, 218, 219.

*Primary Examiner*—Steven L. Stephan
*Assistant Examiner*—Cassandra Spyrou
*Attorney, Agent, or Firm*—Neil F. Markva

[57] ABSTRACT

A musical display combination comprises a postage stamp display mounted on a music box that reproduces an audible rendition of a music composition having a theme that substantively and correspondingly relates to a particular subject matter theme depicted by the visual image of the postage stamp. The postage stamp display includes a postage stamp disposed on a rigid planar thin sheet substrate. An envelope defined by two pliable sheets having an outer edge is secured on the rigid planar thin sheet substrate. A postage stamp is disposed between the sheets within the envelope allowing a visual examination of the postage stamp therethrough. A clear material forms a transparent overlay structure over the postage stamp through which the postage stamp may be viewed.

1 Claim, 4 Drawing Sheets

MUSICAL POSTAGE STAMP DISPLAY DEVICE

FIELD OF THE INVENTION

This invention relates to musical display devices involving a combined display device and a music box structure. More particularly, this invention is directed to a musical device for displaying postage stamps.

BACKGROUND OF THE INVENTION

My earlier U.S. Pat. Nos. 3,522,673 and 4,889,748 relate to particular methods and devices for displaying postage stamps and are herein incorporated in their entirety by reference regarding specific embodiments for producing the products of the present invention.

Known music boxes are mechanical or electro-mechanical. The mechanical music box includes a spring-wound motor that turns a rotor provided rotor lugs which sequentially engage radially disposed pins that audibly vibrate upon rotation of the rotor. The lugs are positioned on the rotor in a tune reproducing order thereby reproducing a melody upon complete rotation of the rotor.

Known electro-mechanical music reproduction structures include electronic circuitry electrically connected to a speaker and power supply for reproducing any desired tune. Both the mechanical and electro-mechanical music reproduction mechanisms include a mechanical activator to start and stop the operation of the respective mechanism for reproducing the desired music. The music mechanisms are respectfully activated and deactivated by either moving or removing a cover from the container holding the music reproduction mechanism or through operation of a switch mechanism.

U.S. Pat. No. 3,523,478 relates to a music box in combination with animated figures whereby the device produces sounds wherein the figures, sounds and music are interrelated.

U.S. Pat. Nos. 2,484,895,; 2,484,896; and 2,570,976 relate to musical books or educational toy books wherein music reproducing means plays tunes of nursery rhymes which relate generally to the story or theme of the particular book having the music, words and/or various illustrations for the subject matter such as nursery rhymes disposed on the book cover or various pages of the book. U.S. Pat. No. 2,279,182 discloses an ornamental tree representing a decorated Christmas tree and attached to a rotatable cylinder which produces music such as Christmas carols. U.S. Pat. No. 4,102,067 discloses a combined greeting card and decorative music box.

Postage stamps and art work incorporating postage stamps are appreciated by the postal patron as well as by collectors of philatelic devices. U.S. Pat. Nos. 3,522,673; 4,083,137 and 4,889,748 disclose various types of mechanisms for mounting postage stamps in overlaying, transparent material for viewing within a philatelic display.

PURPOSE OF THE INVENTION

The particular subject matter theme of the art work appearing on postage stamps is often of the nature that evokes emotion in the observer. Particular examples of such subjects may be of a national battle ground, an American civil rights hero or an historical political figure or event.

A primary object of the invention is to enhance the emotion evoked in the observer by combining the particular subject matter theme of a postage stamp with a musical composition reproduced in a music box. While the various prior art structures related to postage stamps and music boxes have existed side-by-side for many years as indicated by the several patents mentioned above, no teaching or suggestion exists heretofore of combining the particular subject matter theme of a postage stamp with a musical composition reproduced in a music box to provide a musical display combination comprising music reproducing means and postage stamp display means. None of these prior art structures show the type of device or method of making such device as is disclosed and taught for the first time in the present invention.

SUMMARY OF THE INVENTION

The invention is directed to a musical display combination comprising music reproducing means and postage stamp displaying means. The music reproducing means includes memory means and is disposed in container means having a plurality of surfaces and further includes movable means for providing open and closed conditions for the container means. The postage stamp displaying means is located on one of the surfaces of the container means and includes a postage stamp having a visual image with a particular subject matter theme. The music reproducing means is effective to reproduce a musical composition which substantively and correspondingly relates to the subject matter theme of the postage stamp visual image. The music reproducing means includes activator means for activating the means. The activator means may be responsive to movement of a section of music box such as a cover member so that the music reproducing means is activated when the container means is in an open condition. Various switch mechanisms may be used to activate the music without a cover member being moved.

The method of the invention comprises providing a postage stamp displaying means having a postage stamp of a particular subject matter. A music reproducing means including activator means to activate the music reproducing means for producing a musical composition having a subject matter theme that substantively and correspondingly relates to the particular subject matter theme of the postage stamp. The music reproducing means includes memory means with the musical composition stored or built therein and is disposed in container means having a plurality of surfaces. The postage stamp displaying means is then attached to one of the surfaces of the container means.

A feature of the invention is directed to the postage stamp displaying means which includes a rigid planar sheet substrate means having a transparent overlay structure through which the postage stamp and the visual image thereon may be viewed. The postage stamp is mounted between pliable sheets composed of transparent material. The overlay structure of this invention includes laminated transparent plastic or glass and embedment resin material such as epoxy and acrylic resins which form a solid transparent embedment structure. In a specific embodiment, the embedment material forms a transparent dome-shaped structure through which the postage stamp and its displayed visual image may be viewed.

In a particular embodiment, the pliable sheets have an outer edge and form an envelope sealed along the outer edge to confine the postage stamp. Fixing means secures the envelope in a fixed position to the rigid planar sheet substrate means that includes first and second planar sheet substrate members each having a predetermined outer profile and a display face. The first planar sheet substrate member is fixed to the second planar sheet substrate member which is larger than the first planar sheet substrate member. The postage stamp displaying means is fixedly attached to the surface of the music reproducing means.

The fixing means used to secure the envelope to the first planar sheet substrate member may be an adhesive means. The overlay structure includes a contiguously extending layer of transparent material over the pliable sheets to the predetermined outer profile of the first planar sheet substrate member. In another embodiment, the transparent overlay structure may extend to the predetermined outer profile of the second planar sheet substrate member. In either instance, the transparent overlay structure contiguously extends over the entire postage stamp.

As a feature of the invention, the music reproducing means may comprise mechanical operating means or electro-mechanical operating means. The movable means of the container means includes a pivotably mounted means for pivoting between an open position and a closed position. The activator means includes means responsive to the positioning of the pivotably mounted means to activate and deactivate the music reproducing means corresponding to respective of the open and closed positions.

In a specific embodiment, the movable means includes a hinged intermediate section disposed between a cover portion and a bottom portion. The intermediate section is mounted to pivot between an aligned position and unaligned position with respect to the cover portion and the bottom portion. The activator means in this instance activates and deactivates the music reproducing means corresponding to respective of the aligned and unaligned positions.

The mechanical operating means may be of the type having a spring-wound motor for rotating a rotor. The mechanism has radially disposed pins that engage a series of lugs arranged on the rotor in a tune reproducing order. The pins are of a metallic composition and each pin in the series of lug-contacting pins (said series being called a comb) produces a sound upon being plucked by a contacting lug. Upon rotation of the rotor, the pins audibly vibrate to produce the audible rendition of a musical composition. The spring, rotor and comb are located in a box of wood or other materials to amplify the music being reproduced. The music reproduction device is powered by manually winding the spring. An alternative electro-mechanical mechanism may include electronic circuitry with an associated power source and speaker means. The circuitry generates musical tunes via the speaker means with the power source driving the circuitry and speaker means.

In either the electro-mechanical or mechanical mechanisms, a mechanical switch turns the music on and off. Known switches are activated when movable means such as a side, bottom or cover of the music box is moved, removed or rotated between open and closed positions to actuate the switch. Other switches include manually operated switches to activate the music reproducing means without moving a cover. The shape of the music box may be quite diverse to allow for the placement of the music reproducing device therein.

The postage stamp displaying structure is mounted on the music box by any known means, such as adhesives. The postage stamp is mounted on a surface of the music box and has a particular subject matter theme. As noted, the music composition of the music box and the particular postage stamp theme are substantively and correspondingly related. For example, the displayed image of the postage stamp may be Martin Luther King, Jr. and the music reproduced by the music box could be the hymn "We Shall Overcome". Thus, in this instance, both the visual and audible subject matter themes deal with the American civil rights movement. Many possible variations of such related melodies and image themes exist. Significantly, this invention contemplates the first combination of a postage stamp display mounted on a music box in the manner disclosed.

BRIEF DESCRIPTION OF THE DRAWINGS

Other objects of this invention will appear in the following description and appended claims, reference being made to the accompanying drawings forming a part of the specification wherein like reference characters designate corresponding parts in several views.

DETAILED DESCRIPTION

Figure 1:
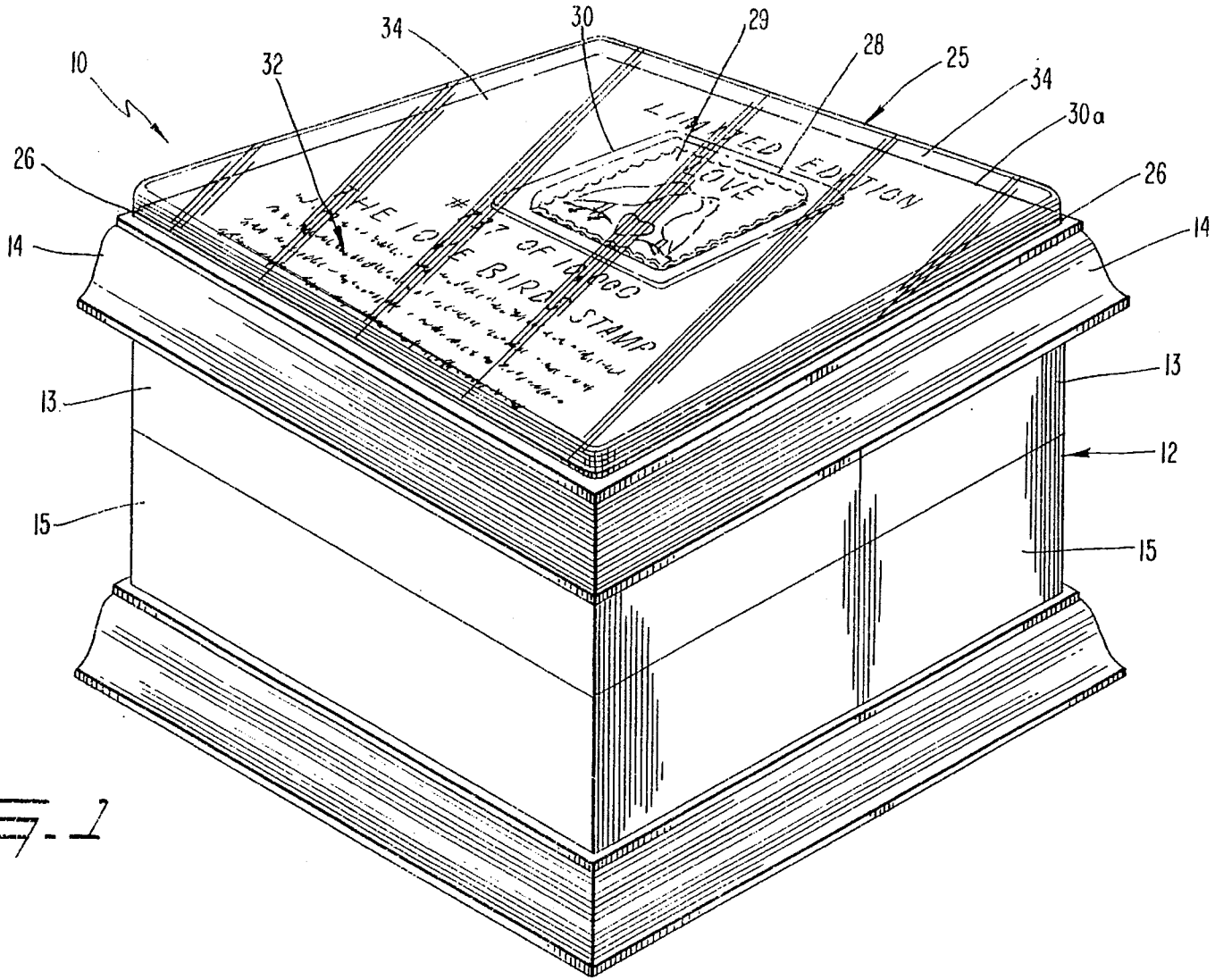
FIG. 1 is a perspective view of a postage stamp musical display device of the invention.
Figure 2:
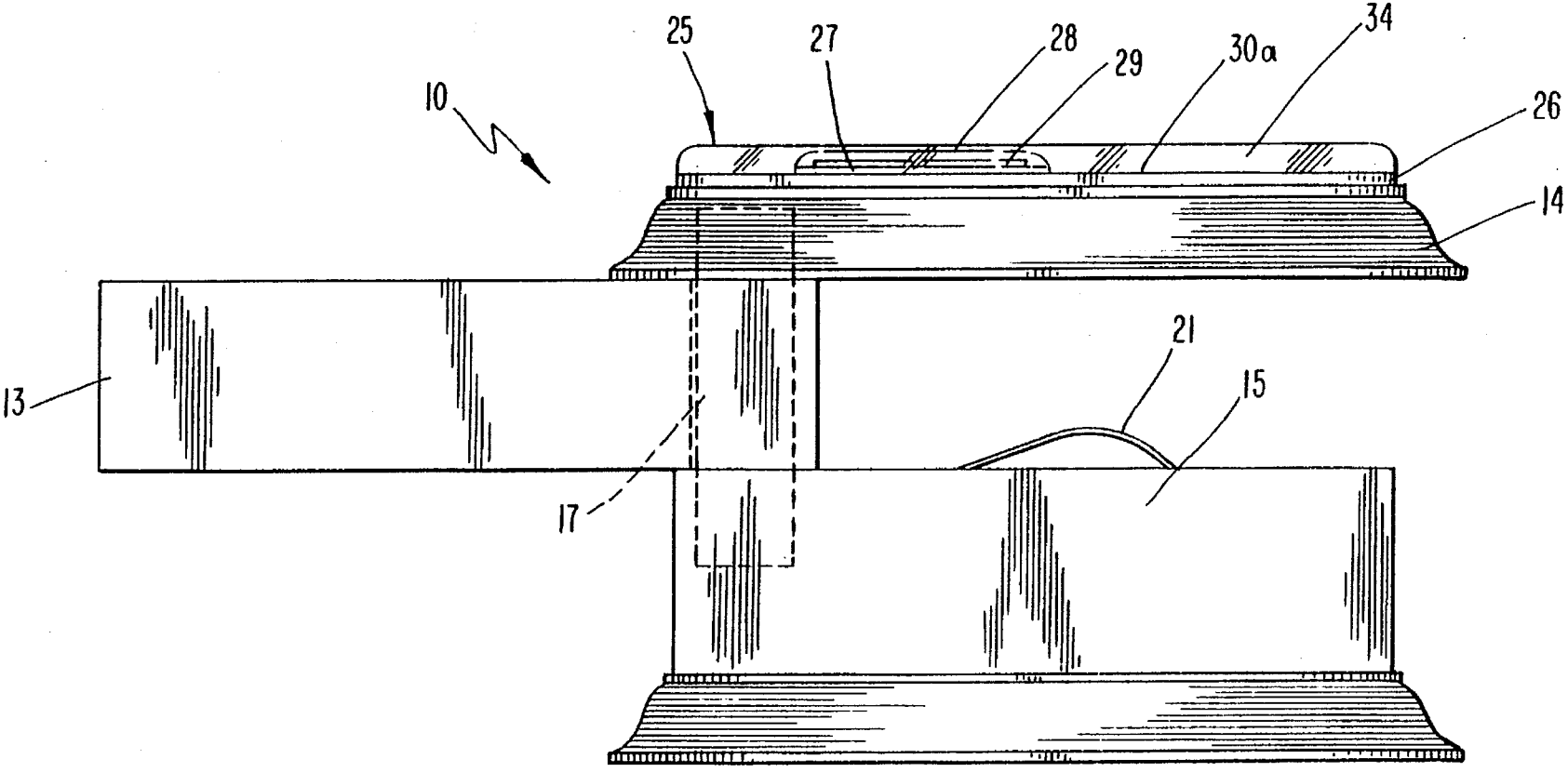
FIG. 2 is an elevational side view of the musical display device of FIG. 1 having an intermediate section in an open position.
Figure 3:
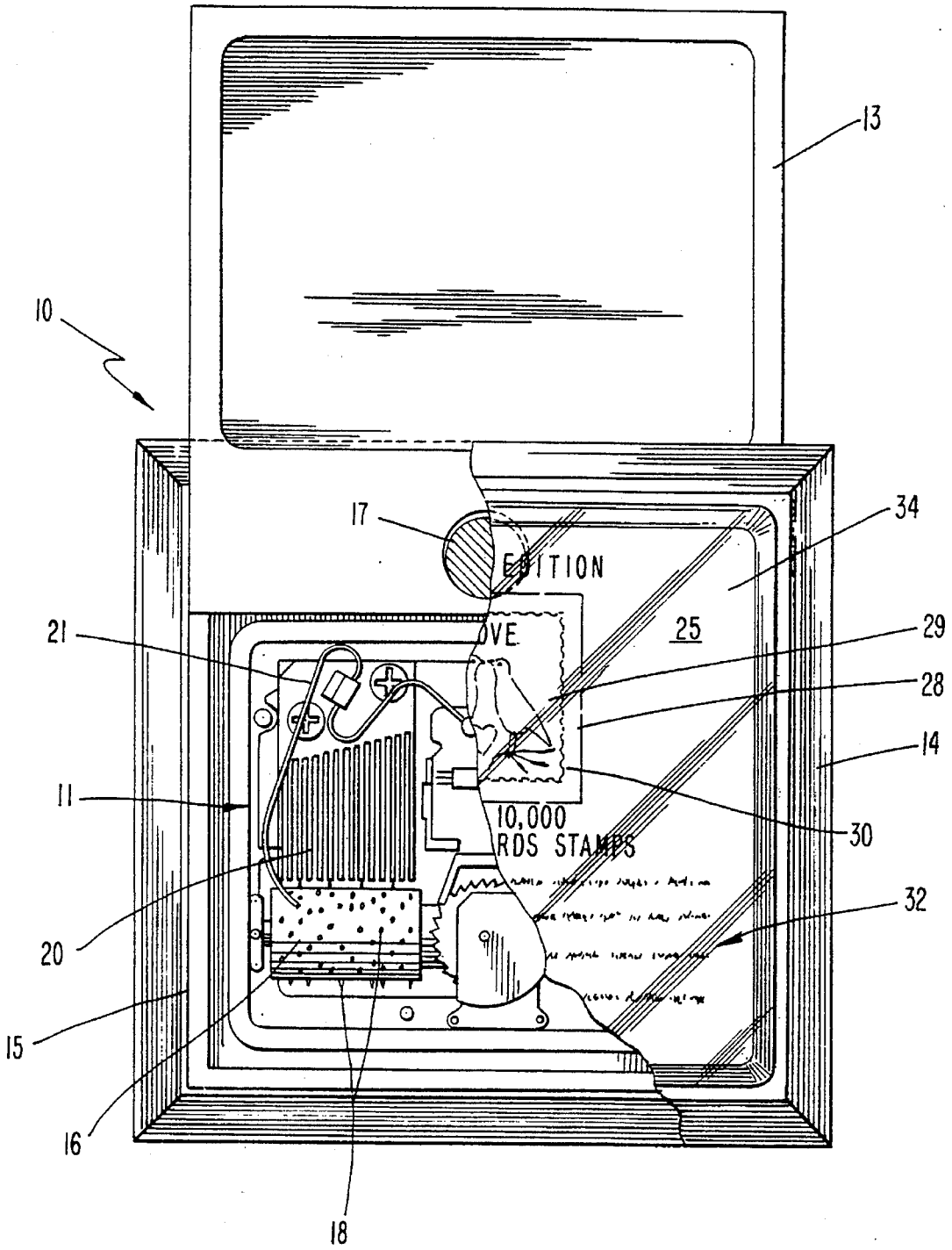
FIG. 3 is a fragmentary top plan view of the musical display device in accordance with the invention as shown in FIG. 2.

The musical display device, generally designated 10 in FIGS. 1–3, comprises music box 12 including cover portion 14, bottom portion 15 and intermediate section 13. A music reproducing mechanism 11 is disposed inside music box 12 and includes rotor 16 having lugs 18 which engage radially disposed pins 20. Lugs 18 are in a tune producing order so that as rotor 16 rotates, pins 20 audibly vibrate to produce musical tones that form an audible melody when mechanism 11 is activated.

As shown in FIG. 2, postage stamp display device, generally designated 25, is disposed on display face 26 and includes pliable sheets 27 and 28 having a postage stamp 29 disposed therebetween. In this embodiment, the outer edges of pliable sheets 27 and 28 are joined to form an envelope in accordance with my earlier U.S. Pat. No. 3,522,673 incorporated by reference herein.

An adhesive material secures sheet 27 to a rigid thin sheet planar substrate 30 and an adhesive material secures planar substrate means 30 to display face 26 on cover portion 14. Adhesive materials may be any available adhesive materials effective to secure the pliable sheet material and rigid thin sheet substrate 30 to the respective contiguous surfaces.

The transparent overlay structure of this embodiment is a clear dome-shaped material 34 such as an epoxy or acrylic resin is poured to contiguously extend over the entire postage stamp 29 and rigid planar substrate 30 to its predetermined outer profile as shown. Indicia 32 disposed on substrate 30 communicates a message and information regarding postage stamp 29. Dome-shaped material 34 forms a transparent structure through which postage stamp 29 may be viewed. A color background 30*a* is imprinted on substrate member 30 highlights postage stamp 29.

Intermediate section 13 rotates between an aligned and unaligned position about pin 17 extending between cover portion 14 and bottom portion 15. Intermediate section 13 is in a closed position as shown in FIG. 1 and in an open position as shown in FIGS. 2 and 3. As intermediate section 13 pivots about pin 17 between open and closed positions, activator arm 21 moves upwardly and downwardly as the bottom of section 13 contacts arm 21 in its movement about pin 17 to thereby activate and deactivate the music producing mechanism 11. In this embodiment, with the "Love Birds" stamp 29, the accompanying tune is "Love Makes The World Go Round" and therefore substantively and correspondingly relates to the subject matter of the particular postage stamp theme. Other musical compositions related to the "Love Theme" for postage stamp 29 might also be used. Another combination might include a Christmas stamp used with selected Christmas music.

Figure 4:
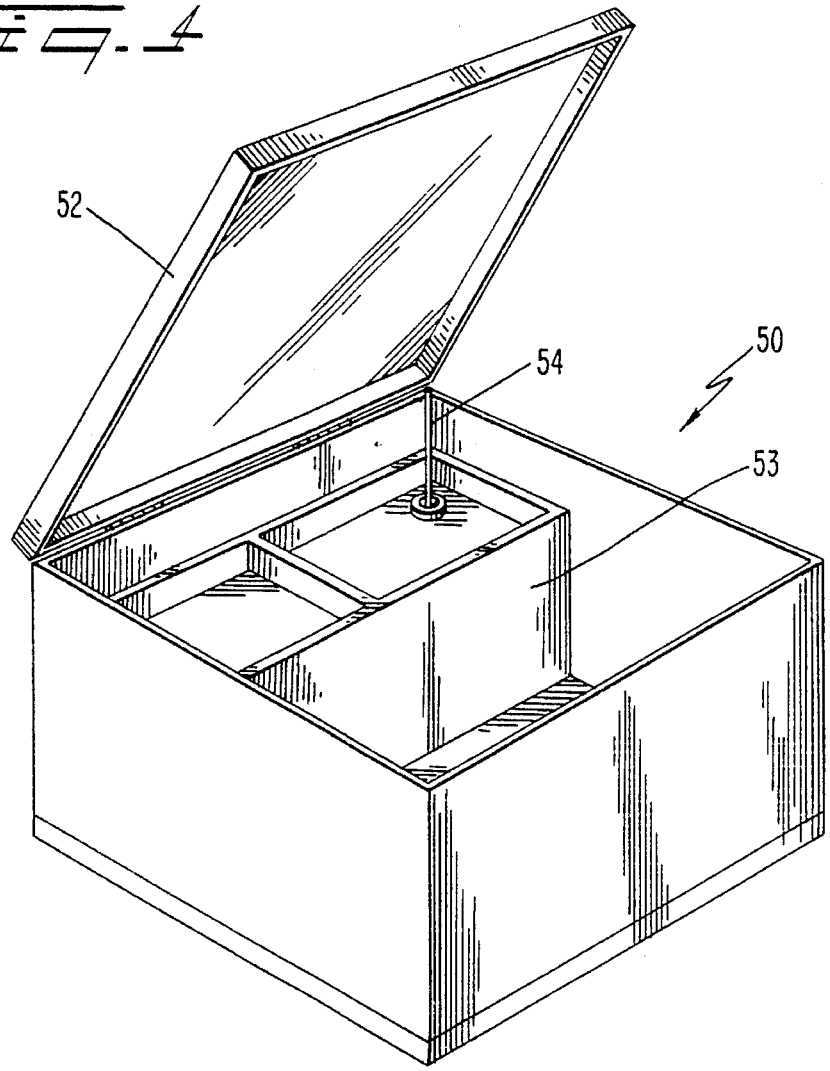
FIG. 4 is a perspective view of another embodiment of a musical postage stamp display device made in accordance with the invention, said embodiment having a pivotable opening and closing hinged side wall section.

The embodiment of FIG. 4 shows a music box, generally designated 50, having a cover member 52 that pivots along one edge thereof as shown. An activating device 54 moves upwardly and downwardly depending upon the open and closed position of cover 52 for activating or deactivating the music reproducing mechanism (not shown) housed by the container 53. The postage stamp (not shown) has a particular theme and is disposed on the obverse side or top of cover member 52.

Figure 5:
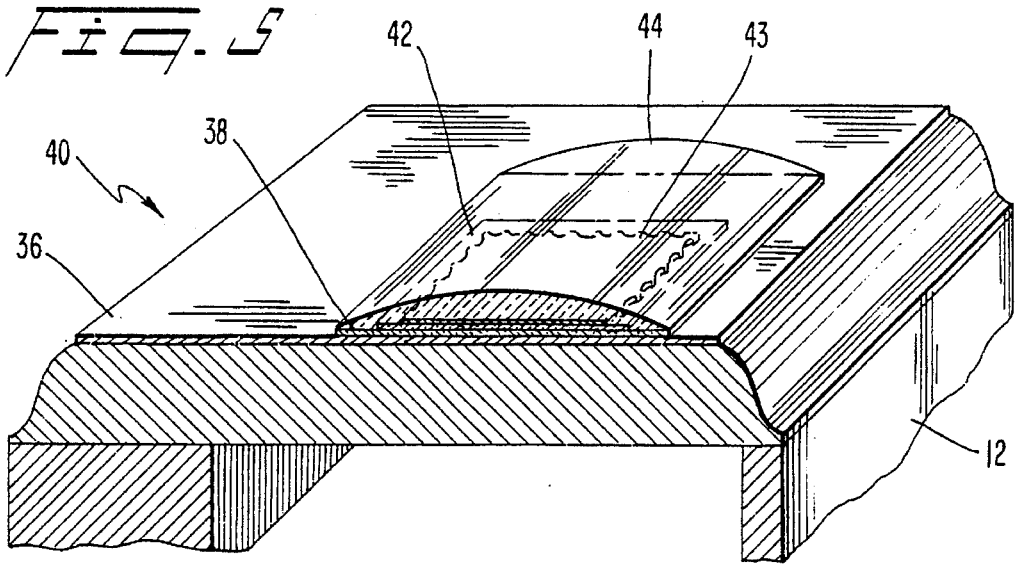
FIG. 5 is a perspective fragmentary sectional view of another embodiment of a musical display device of the invention.

The embodiment of FIG. 5 discloses a display device, generally designated 40, on music box 12. First and second thin sheet substrate members 36 and 38 having a plated coating of precious metal such as silver or gold. Alternatively, the entire thickness of either substrate member 36 or 38 may be composed of a precious metal.

The first substrate member 36 is composed of a rigid thin planar sheet material and carries a combination of an envelope 42 of pliable material having postage stamp 43 disposed therein. The overlay structure is an epoxy resin that forms a transparent dome-like structure 44 over envelope 42 and over thin sheet substrate member 38 as shown.

An adhesive material is used between substrate members 36 and 38 and for securing the postage stamp-containing envelope 42 to substrate member 36. The outer shape of the display devices 25 and 40 may have any desired configuration defining the outer profile of rigid members 36 and 38.

In each of the embodiments, thin sheet substrates 30, 36 and 38 have a thickness of from 1/32 to 3/32 of an inch. The thickness will vary depending upon the material being used and the particular type of postage stamp display being fabricated. Furthermore, other overlay structures such as transparent sheets of Lucite, glass and the like may be used instead of or in combination with embedment materials such as epoxy and acrylic resins. Various types of fixing means may be used to secure the transparent sheets to a substrate means with the postage stamp disposed therebetween. The music box container may be composed of any known material including wood, plastic, ceramic and the like.

While the musical postage stamp display device has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A musical display combination comprising:

a) music reproducing means and postage stamp displaying means, b) said music reproducing means being disposed in a box having a plurality of outer surfaces and movable means for providing an open and closed condition for the box, c) said postage stamp displaying means being disposed on an outer surface of the box, d) said postage stamp displaying means including a postage stamp having a visual image with a particular subject matter theme, e) said music reproducing means being effective to reproduce an audible rendition of a musical composition which substantively and correspondingly relates to the subject matter theme of the postage stamp visual image, f) activator means for activating the music reproducing means g) said movable means includes a hinged intermediate section disposed between a cover portion and a bottom portion of said box, h) said intermediate section is mounted to pivot between an aligned position and an unaligned position with respect to said cover portion and said bottom portion, and i) said activator means includes means responsive to movement of the intermediate section to activate and deactivate said music reproducing means corresponding to respective of said aligned and unaligned positions.

* * * * *